US008260186B2

(12) United States Patent
Kubota et al.

(10) Patent No.: US 8,260,186 B2
(45) Date of Patent: Sep. 4, 2012

(54) TONER CARTRIDGE WITH REFILLABLE FRESH AND RESIDUAL TONER CHAMBERS, PROCESS CARTRIDGE, AND METHOD OF MAKING TONER CARTRIDGE REUSABLE

(75) Inventors: Tomohiro Kubota, Osaka (JP); Tomofumi Yoshida, Ibaraki (JP); Kenzo Tatsumi, Osaka (JP); Hirobumi Ooyoshi, Ibaraki (JP); Yoshiyuki Shimizu, Osaka (JP); Yoshihiro Kawakami, Hyogo (JP); Koji Kato, Ibaraki (JP); Yutaka Naitoh, Hyogo (JP)

(73) Assignee: Ricoh Company, Limited, Tokyo (JP)

( * ) Notice: Subject to any disclaimer, the term of this patent is extended or adjusted under 35 U.S.C. 154(b) by 993 days.

(21) Appl. No.: 12/170,842

(22) Filed: Jul. 10, 2008

(65) Prior Publication Data

US 2009/0022531 A1 Jan. 22, 2009

(30) Foreign Application Priority Data

Jul. 18, 2007 (JP) ..... 2007-186819
Nov. 28, 2007 (JP) ..... 2007-307227

(51) Int. Cl.
*G03G 21/00* (2006.01)

(52) U.S. Cl. ..... 399/358

(58) Field of Classification Search ..... 399/358, 399/359, 360, 109
See application file for complete search history.

(56) References Cited

U.S. PATENT DOCUMENTS 4,816,877 A * 3/1989 Keen ..... 355/133
2007/0104523 A1* 5/2007 Yoshida et al. ..... 399/358
2007/0140763 A1 6/2007 Shimizu et al.
2007/0248390 A1 10/2007 Kubota et al.
2008/0019720 A1 1/2008 Kawakami et al.
2008/0089727 A1 4/2008 Shimizu et al.
2008/0095559 A1 4/2008 Shimizu et al.
2008/0145108 A1 6/2008 Yoshida et al.
2008/0145109 A1 6/2008 Murayama et al.
2008/0145119 A1 6/2008 Tatsumi et al.
2008/0152408 A1 6/2008 Kawakami et al.

FOREIGN PATENT DOCUMENTS

JP 4-280261 10/1992
JP 5-165326 7/1993
JP 6-67579 3/1994
JP 08202240 A * 8/1996
JP 8-305163 11/1996
JP 09258537 A * 10/1997

(Continued)

OTHER PUBLICATIONS

Machine English Translation of JP08-202240 published on Aug. 9, 1996.*

(Continued)

*Primary Examiner* — Walter L Lindsay, Jr.
*Assistant Examiner* — Billy J Lactaoen
(74) *Attorney, Agent, or Firm* — Oblon, Spivak, McClelland, Maier & Neustadt, L.L.P.

(57) ABSTRACT

A toner cartridge is configured by integrally arranging a fresh toner storing chamber and a residual toner collection chamber. Fresh toner is filled in the fresh toner storing chamber through a fresh toner filling opening. Residual toner is conveyed in the residual toner collection chamber through a residual toner conveying opening. Two residual toner discharging openings are created in the residual toner collection chamber through which the residual toner is discharged.

8 Claims, 11 Drawing Sheets

FOREIGN PATENT DOCUMENTS

| | | | | |
|---|---|---|---|---|
| JP | 11153901 | A | * | 6/1999 |
| JP | 2001117470 | A | * | 4/2001 |
| JP | 2002-91149 | | | 3/2002 |
| JP | 3320191 | | | 6/2002 |
| JP | 2003-29601 | | | 1/2003 |
| JP | 2003-57933 | | | 2/2003 |
| JP | 2003-295592 | | | 10/2003 |
| JP | 2006-85124 | | | 3/2006 |
| JP | 4028666 | | | 10/2007 |

OTHER PUBLICATIONS

Japanese Office Action issued May 15, 2012 in Patent Application No. 2007-307227.

* cited by examiner

TONER CARTRIDGE WITH REFILLABLE FRESH AND RESIDUAL TONER CHAMBERS, PROCESS CARTRIDGE, AND METHOD OF MAKING TONER CARTRIDGE REUSABLE

CROSS-REFERENCE TO RELATED APPLICATIONS

The present application claims priority to and incorporates by reference the entire contents of Japanese priority documents 2007-307227 filed in Japan on Nov. 28, 2007 and 2007-186819 filed in Japan on Jul. 18, 2007.

BACKGROUND OF THE INVENTION

1. Field of the Invention

The present invention relates to a technology of making a toner cartridge reusable in an image forming apparatus.

2. Description of the Related Art

An image forming apparatus includes a plurality of consumable image forming components such as an image carrying member and a developing unit. The developing unit includes rotatable components such as a developing roller and an agitating screw that undergo wear and tear over time. The image carrying member also undergoes wear and tear by being frequently exposed to light for image formation. Moreover, the amount of a developer (e.g., a one-component developer or a two-component developer) in the developing unit or the toner concentration in the developer decreases over time. Thus, it becomes necessary to frequently refill the developer or the toner. For that, automating the process of toner refilling or the process of toner carrier replacement has been proposed.

In previous times, one had to rely on a technical serviceman to replace an image carrying member or a developing unit, which has undergone wear and tear, from an image forming apparatus. However, in recent times, the image carrying member and the developing unit are integrally arranged to form a process cartridge that can be detachably attached to an image forming apparatus. As a result, even a common user can replace an entire process cartridge when one or more image forming components therein undergo wear and tear. That enhances the work efficiency of the common user while using the image forming apparatus. Usually, such replaced process cartridges are collected and only those image forming components that have undergone wear and tear are replaced with new image forming components. In this way, the replaced process cartridges can be made reusable thereby saving resources.

Moreover, from the resource saving perspective, the residual toner after an image forming process is collected from an image carrying member and re-conveyed to a developing unit for reuse. However, there is a possibility that the residual toner is in a deteriorated state of quality due to agitation, conveyance, or electrical action during the image forming process. Hence, it is also a common practice to scrap the residual toner as waste toner. Generally, a detachable toner cartridge is used to scrap the waste toner. That is because a toner cartridge is configured by integrally arranging a waste toner collection chamber and a fresh toner storing chamber. Thus, by using such a toner cartridge, there is no need to arrange a waste toner collection chamber and a fresh toner storing chamber separately in an image forming apparatus. The toner cartridge can be easily replaced when the waste toner collection chamber is filled to capacity.

Various techniques have been disclosed to refill fresh toner in a toner cartridge. For example, Japanese Patent No. 3320191 discloses a technique for refilling a toner cartridge in which a fresh toner filling opening and a residual toner discharging opening are created. The fresh toner filling opening is closed by a cap and covered by a holding member. In such a toner cartridge, fresh toner can be refilled by dismounting the holding member, removing the cap, sealing the residual toner discharging opening, filling fresh toner through the fresh toner filling opening, fitting the cap to the fresh toner filling opening, and re-fixing the holding member to cover the fresh toner filling opening. Similarly, Japanese Patent Application Laid-open No. 2003-57933 discloses a technique for refilling fresh toner in a process cartridge by creating an opening in the process cartridge housing, fixing a tubular member in the opening, refilling fresh toner through the tubular member, and fitting a cap to the tubular member.

However, with the recent awareness regarding environmental concerns, emphasis is being given on saving resources by reuse. That also helps in cutting down the manufacturing cost. In that light, it is necessary to configure a toner cartridge with respect to which refilling of fresh toner as well as discharging of residual toner can be easily performed.

Meanwhile, from the image quality perspective, it is also necessary to efficiently remove remaining unused toner from a fresh toner storing chamber in a toner cartridge before refilling the fresh toner. That is because the unused toner remaining in the fresh toner storing chamber for a long time can affect the image density or the background density of an image thereby deteriorating the image quality.

SUMMARY OF THE INVENTION

It is an object of the present invention to at least partially solve the problems in the conventional technology.

According to one aspect of the present invention, there is provided a toner cartridge including a fresh toner storing chamber in which fresh toner is stored, the fresh toner being used for developing an image, the fresh toner storing chamber having a fresh toner filling opening through which the fresh toner is filled therein; and a residual toner collection chamber in which residual toner is collected, the residual toner being a toner removed after an image is developed by using the fresh toner, the residual toner collection chamber having a residual toner conveying opening through which the residual toner is conveyed thereto and two residual toner discharging openings through which the residual toner can be discharged therefrom, the fresh toner storing chamber and the residual toner collection chamber being arranged integrally.

According to another aspect of the present invention, there is provided a process cartridge that is configured by integrally arranging a photosensitive drum, a developing unit, and the above toner cartridge.

According to still another aspect of the present invention, there is provided a method of making the above toner cartridge reusable, the method including removing the sealing member from each of the residual toner discharging openings; and suctioning the residual toner from the residual toner collection chamber through either one of the residual toner discharging openings.

According to still another aspect of the present invention, there is provided a method of making the above toner cartridge reusable, the method including removing the sealing member from each of the residual toner discharging openings; blowing air intermittently through either one of the residual toner discharging openings; and discharging the residual toner from the residual toner collection chamber through one of the residual toner discharging openings not used at the blowing.

According to still another aspect of the present invention, there is provided a method of making the above toner cartridge reusable, the method including dismounting a developer conveying member arranged opposite to the fresh toner storing chamber to create an unused toner discharging opening; blowing air through the fresh toner filling opening; and discharging remaining unused toner from the fresh toner storing chamber through the unused toner discharging opening.

According to still another aspect of the present invention, there is provided a method of making the above toner cartridge reusable, the method including dismounting a toner supply regulating member arranged opposite to the fresh toner storing chamber to create an unused toner discharging opening; blowing air through the fresh toner filling opening; and discharging remaining unused toner from the fresh toner storing chamber through the unused toner discharging opening.

According to still another aspect of the present invention, there is provided a method of making the above toner cartridge reusable, the method including dismounting either one of a developer conveying member and a toner supply regulating member arranged opposite to the fresh toner storing chamber to create an unused toner discharging opening; blowing air simultaneously through the fresh toner filling opening and either one of the residual toner discharging openings; and discharging remaining unused toner from the fresh toner storing chamber through the unused toner discharging opening and the residual toner from the residual toner collection chamber through one of the residual toner discharging openings not used at the blowing.

According to still another aspect of the present invention, there is provided a method of making the above toner cartridge reusable, the method including dismounting either one of a developer conveying member and a toner supply regulating member arranged opposite to the fresh toner storing chamber to create an unused toner discharging opening; blowing air alternately through the fresh toner filling opening and either one of the residual toner discharging openings; and discharging remaining unused toner from the fresh toner storing chamber through the unused toner discharging opening and the residual toner from the residual toner collection chamber through one of the residual toner discharging openings not used at the blowing.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. The present invention is not limited to these exemplary embodiments.

Figure 1:
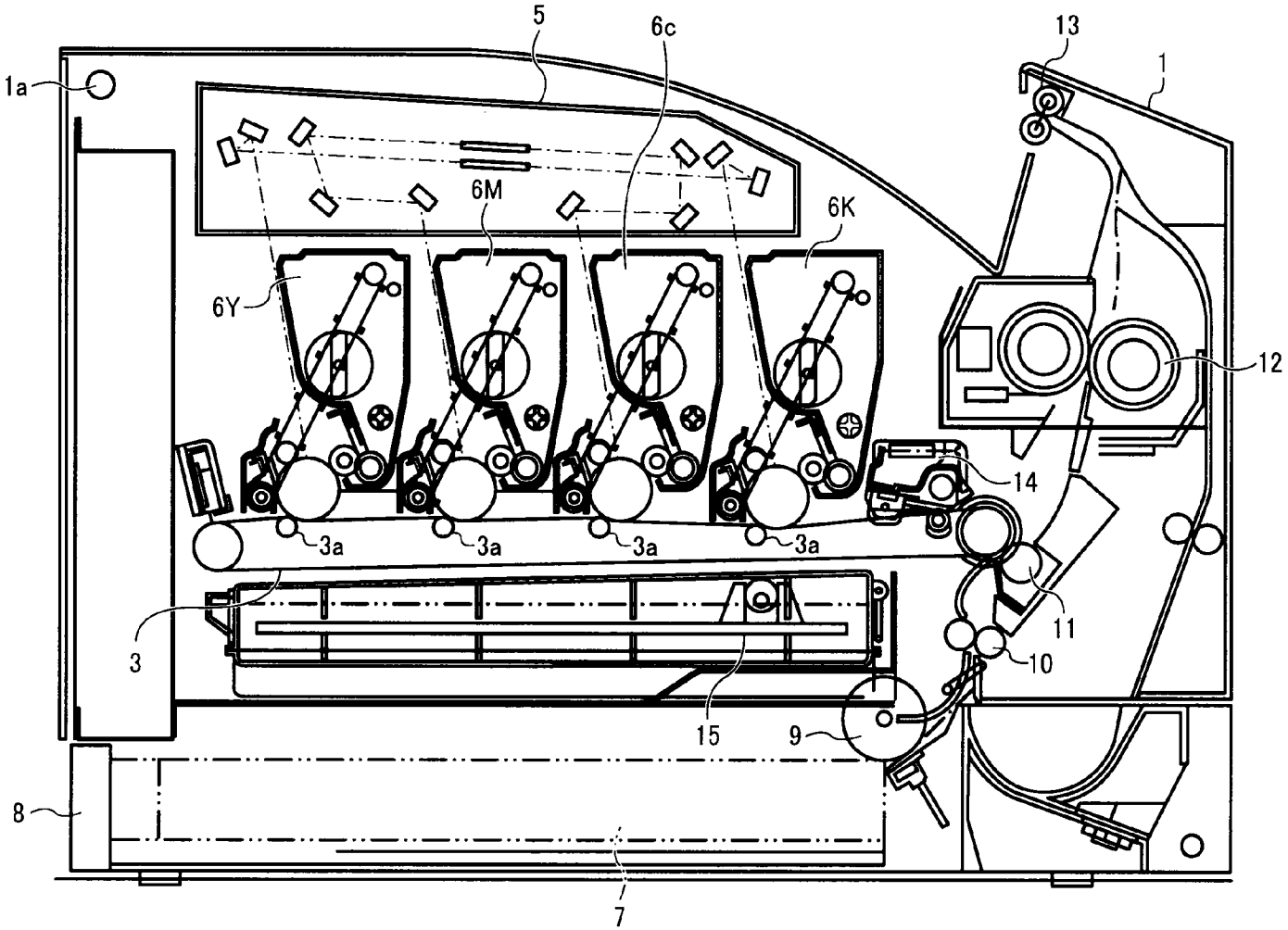
FIG. 1 is a schematic diagram of an image forming apparatus according to an embodiment of the present invention.

FIG. 1 is a schematic diagram of an image forming apparatus 1 such as a color printer according to an embodiment of the present invention. The image forming apparatus 1 includes four image forming units 6Y, 6M, 6C, and 6K that form a toner image in yellow, magenta, cyan, and black, respectively. A light exposing unit 5 is arranged above the image forming units 6Y, 6M, 6C, and 6K. The light exposing unit 5 exposes a photosensitive drum in each of the image forming units 6Y, 6M, 6C, and 6K such that an electrostatic latent image is formed on the photosensitive drum. An intermediate transfer belt 3 is horizontally stretched around a plurality of supporting rollers beneath the image forming units 6Y, 6M, 6C, and 6K. A secondary transfer unit 11 and a belt cleaning unit 14 are arranged on the right side of the intermediate transfer belt 3 with reference to FIG. 1. A waste toner container 15 and a feeding cassette 8 are arranged beneath the intermediate transfer belt 3. The belt cleaning unit 14 removes waste toner from the intermediate transfer belt 3. The waste toner is then collected in the waste toner container 15. In the feeding cassette 8, a plurality of sheets of a recording medium 7 (hereinafter, "sheet 7") can be stacked. The feeding cassette 8 feeds a single sheet 7 at a time from the stack. A feeding roller 9 and a pair of sheet conveying rollers 10 convey the fed sheet 7 to a secondary transfer nip formed between the intermediate transfer belt 3 and the secondary transfer unit 11. While passing through the secondary transfer nip, a toner image is secondary-transferred on the sheet 7. Subsequently, the sheet 7 is conveyed to a fixing unit 12 that fixes the toner image onto the sheet 7 by applying heat and pressure.

Figure 2:
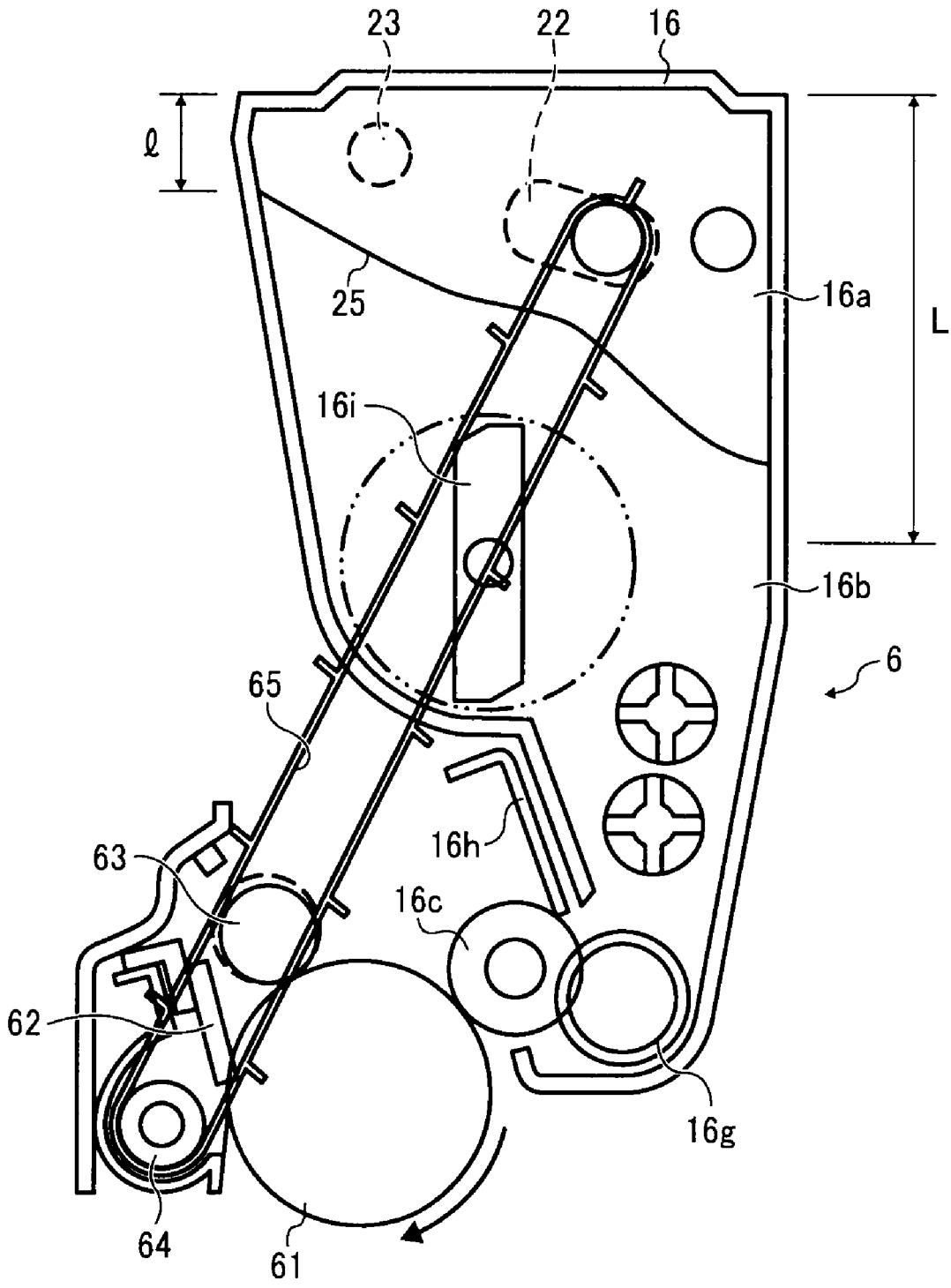
FIG. 2 is a schematic diagram of an image forming unit in the image forming apparatus.

Except for the color of toner, each of the image forming units 6Y, 6M, 6C, and 6K have an identical structure. Hence, for simplification, the structure and the functioning of the image forming units 6Y, 6M, 6C, and 6K is described hereinafter with reference to a single image forming unit 6 without considering the color of toner. FIG. 2 is schematic diagram of the image forming unit 6. As shown in FIG. 2, a photosensitive drum 61 is arranged in the bottom part of the image forming unit 6, while a developing unit 16 is arranged in the upper part of the image forming unit 6. Moreover, a cleaning blade 62 and a charging roller 63 are arranged to abut against the photosensitive drum 61. The photosensitive drum 61, which is an image carrying member, is arranged to abut against the intermediate transfer belt 3 and is rotated in the clockwise direction. Meanwhile, instead of the photosensitive drum 61, a photosensitive member made of an endless belt can also be used as an image carrying member. The developing unit 16 is divided into a residual toner collection chamber 16*a* and a fresh toner storing chamber 16*b*. The fresh toner storing chamber 16*b* is arranged in the central part of the developing unit 16 and is partitioned from the residual toner collection chamber 16*a* by a partitioning member 25. Thus, residual toner in the residual toner collection chamber 16*a* and the fresh toner in the fresh toner storing chamber 16*b* do not mix with each other. A developing roller 16*c*, an agitating gear 16*i*, a toner-circulating upper agitating screw 16*j*, a toner-circulating lower agitating screw 16*k*, a toner supplying roller 16*g*, and a toner supply regulating blade 16*h* are arranged in the fresh toner storing chamber 16*b*. A powdery toner of a predetermined color is filled in the fresh toner storing chamber 16*b*. The partitioning member 25 is fabricated by thermally compressing, e.g., 6 millimeter thick foamed polyurethane to a thickness of 1 millimeter and is flexible in nature. Moreover, the partitioning member 25 is fixed in a corrugated shape across the housing of the developing unit 16. The developing roller 16*c* is either arranged close to the photosensitive drum 61 in a non-contact manner or arranged to abut against the photosensitive drum 61. A negative bias voltage of an alternate current (AC) superimposition is applied from a bias supply (not shown) to the cored bar of the developing roller 16*c*. Similarly, a negative bias voltage of a direct current (DC) is applied from another bias supply (not shown) to the charging roller 63. When a toner image is primary-transferred from the photosensitive drum 61 on the intermediate transfer belt 3, the cleaning blade 62 removes residual toner from the surface of the photosensitive drum 61. Subsequently, a toner conveying coil 64 arranged near the cleaning blade 62 horizontally conveys the residual toner to a toner conveying belt 65. The toner conveying belt 65 then pumps up the residual toner to the residual toner collection chamber 16*a*. The residual toner is conveyed in the residual toner collection chamber 16*a* via a residual toner conveying opening 22 created in the developing unit 16. The description of pumping up the residual toner to the residual toner collection chamber 16*a* is given below in detail.

When a driving motor (not shown) rotates the photosensitive drum 61 in the clockwise direction, the charging roller 63 uniformly charges the surface of the photosensitive drum 61 with a high voltage. Subsequently, based on image data, the light exposing unit 5 selectively exposes the surface of the photosensitive drum 61 to light. Consequently, the voltage at portions that are exposed to light decreases thereby forming low voltage portions and high voltage portions on the surface of the photosensitive drum 61. Due to such different-voltage portions, an electrostatic latent image is formed on the surface of the photosensitive drum 61. When the low voltage portions (or the high voltage portions) of the electrostatic latent image reach the developing roller 16*c*, a toner coated on the developing roller 16*c* is applied to the surface of the photosensitive drum 61. As a result, the electrostatic latent image is developed into a single-color toner image. The single-color toner image is then primary-transferred on the intermediate transfer belt 3. Subsequently, the cleaning blade 62 removes the residual toner from the surface of the photosensitive drum 61 and a neutralizing unit (not shown) removes the residual charge from the surface of the photosensitive drum 61. Thus, the photosensitive drum 61 is reinitialized for subsequent toner image formation.

A primary transfer roller 3*a* is arranged on the inner side of the intermediate transfer belt 3 at the abutting portion of the photosensitive drum 61 and the intermediate transfer belt 3 (see FIG. 1). A high voltage is applied to the primary transfer roller 3*a* such that a potential difference occurs between the photosensitive drum 61 and the intermediate transfer belt 3. As a result, the single-color toner image is primary-transferred from the photosensitive drum 61 on the intermediate transfer belt 3. As described above, the color of toner in each of the image forming units 6Y, 6M, 6C, and 6K, is mutually different. That is, the image forming units 6Y, 6M, 6C, and 6K form a toner image in yellow, magenta, cyan, and black, respectively. Thus, a single-color toner image formed in each of the image forming units 6Y, 6M, 6C, and 6K is sequentially primary-transferred on the intermediate transfer belt 3 and superimposed on one another to form a full-color toner image. Meanwhile, a sheet 7 fed from the feeding cassette 8 is conveyed at an appropriate timing such that the full-color toner image (or a single-color toner image) and the sheet 7 simultaneously reach the secondary transfer nip. A high voltage is applied to the secondary transfer unit 11 such that a potential difference occurs between the intermediate transfer belt 3 and the secondary transfer unit 11. As a result, when the sheet 7 passes through the secondary transfer nip, the full-color toner image is secondary-transferred thereon from the intermediate transfer belt 3. The sheet 7 then reaches the fixing unit 12, which fixes the full-color toner image onto the sheet 7 by applying heat and pressure. Subsequently, the sheet 7 is discharged to a catch tray via a pair of discharge rollers 13. The catch tray is arranged on the top surface of the housing of image forming apparatus 1. When the full-color toner image is secondary-transferred on the sheet 7, the belt cleaning unit 14 removes the waste toner from the intermediate transfer belt 3. The waste toner is then collected in the waste toner container 15. In this way, the intermediate transfer belt 3 becomes ready for subsequent toner image formation.

Figure 3:
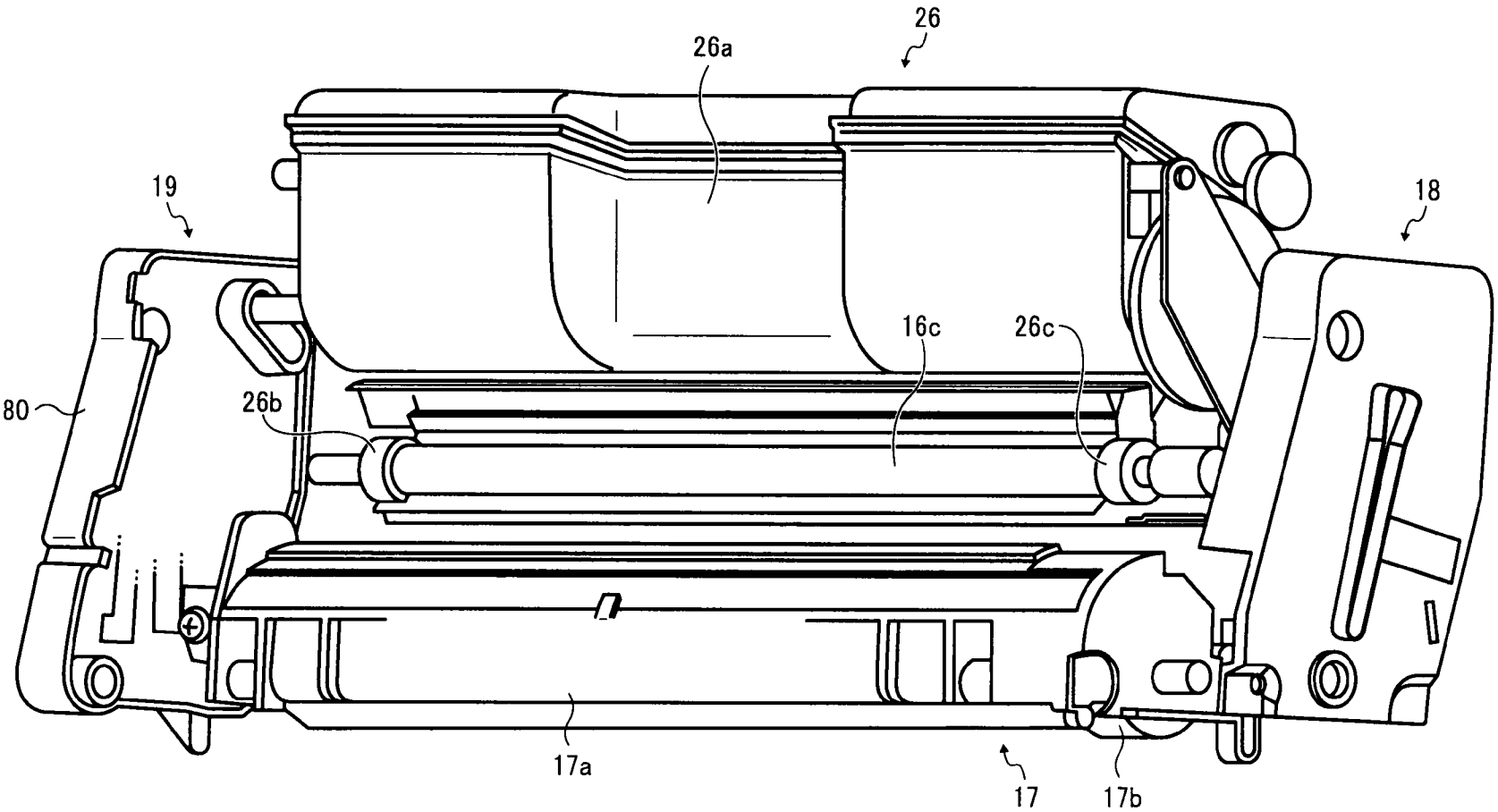
FIG. 3 is an exploded perspective view of a process cartridge that includes the image forming unit.

Meanwhile, the image forming unit 6, which includes the photosensitive drum 61, the developing unit 16, the cleaning blade 62, and the charging roller 63, is configured as a detachable process cartridge. That is, the process cartridge including the image forming unit 6 can be attached to or detached from the main body of the image forming apparatus 1 in a slidable manner. Generally, a process cartridge detachable with respect to an image forming apparatus is configured by integrally arranging an image carrying member and at least a developing unit. However, a process cartridge according to the embodiment is configured by arranging a photosensitive drum and a detachable toner cartridge. FIG. 3 is an exploded perspective view of the process cartridge including the image forming unit 6. The process cartridge is configured by arranging a developing mechanism 26 as a detachable toner cartridge (hereinafter, "toner cartridge 26"), an image carrying unit 17, a left sideboard 18, and a residual toner conveying unit 19. The left sideboard 18 and the residual toner conveying unit 19 are arranged to sandwich and support the toner cartridge 26 and the image carrying unit 17 by using any conventional sandwiching technique such as protrusion-depression assembly. The toner conveying belt 65 is arranged in a toner conveying housing 80 of the residual toner conveying unit 19. The toner conveying belt 65 pumps up the residual toner from the image carrying unit 17 to the toner cartridge 26.

In the toner cartridge 26, the developing roller 16*c* is supported at the ends by two support bearings 26*b* and 26*c* that are fixed to the lateral sides of a toner cartridge housing 26*a*. That is, the two support bearings 26*b* and 26*c* support a predetermined portion at the ends of the shaft of the developing roller 16*c*. The photosensitive drum 61 is supported by two support bearings 17*b* that are fixed to the lateral sides of an image carrying housing 17*a*. That is, the two support bearings 17*b* support a predetermined portion at the ends of the shaft of the photosensitive drum 61. For convenience of graphic depiction, only one of the two support bearings 17*b* is shown in FIG. 3. Meanwhile, the detailed description regarding the structure of the left sideboard 18 and the residual toner conveying unit 19 is omitted because it is not directly related to the object of the present invention.

As shown in FIG. 2, the partitioning member 25 is arranged in a slanting manner to partition the residual toner collection chamber 16*a* and the fresh toner storing chamber 16*b*. Because of the slanting partitioning member 25, the lateral sides of the residual toner collection chamber 16*a* have different heights. That is, a height 1 of a lateral side closer to a residual toner discharging opening 23 is shorter than a height L of a lateral side closer to the residual toner conveying opening 22. Such a difference in heights of the lateral sides is used to efficiently suction the residual toner from the residual toner collection chamber 16*a* through the residual toner discharging opening 23. More particularly, while suctioning the residual toner, the developing unit 16 is rotated in 90° such that the lateral side of the residual toner collection chamber 16*a* having height 1 faces vertically downward. Consequently, the residual toner in the residual toner collection chamber 16*a* accumulates at that lateral side due to gravity. Thus, it becomes easier to suction the residual toner through the residual toner discharging opening 23.

Figure 4:
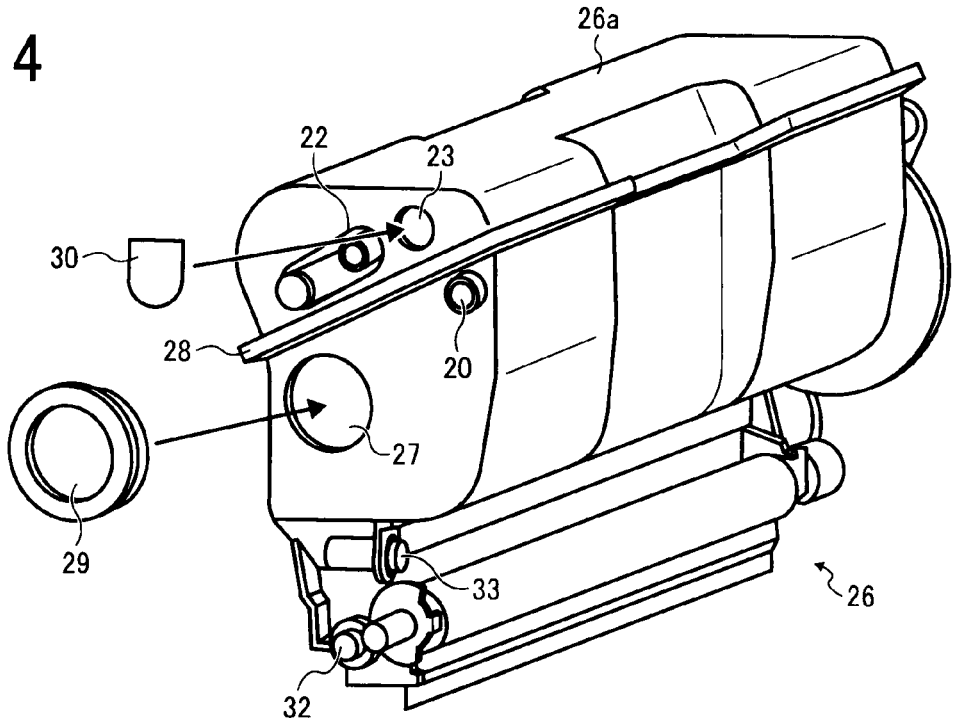
FIG. 4 is a front perspective view of the process cartridge.
Figure 5:
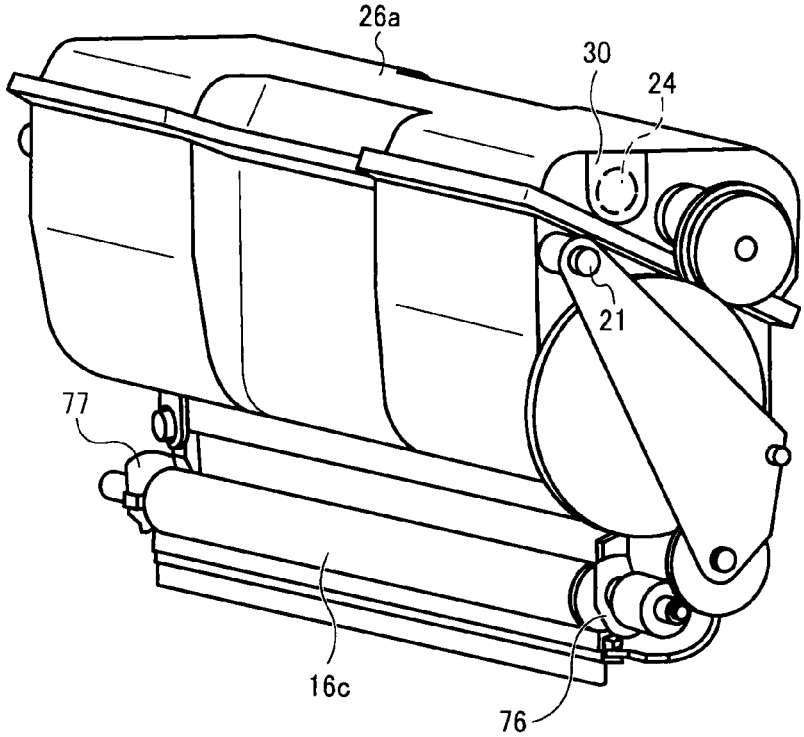
FIG. 5 is another front perspective view of the process cartridge from a different angle.

A boss 20 is arranged in the upper portion of the right lateral side of the toner cartridge housing 26*a* (see FIG. 4), while a boss 21 is arranged in the upper portion of the left lateral side of the toner cartridge housing 26*a* (see FIG. 5). Each of the bosses 20 and 21 fits in an elongated opening created in the residual toner conveying unit 19 and the left sideboard 18, respectively. As a result, the toner cartridge 26 is supported in a slidable manner with respect to the left sideboard 18 and the residual toner conveying unit 19.

Figure 6:
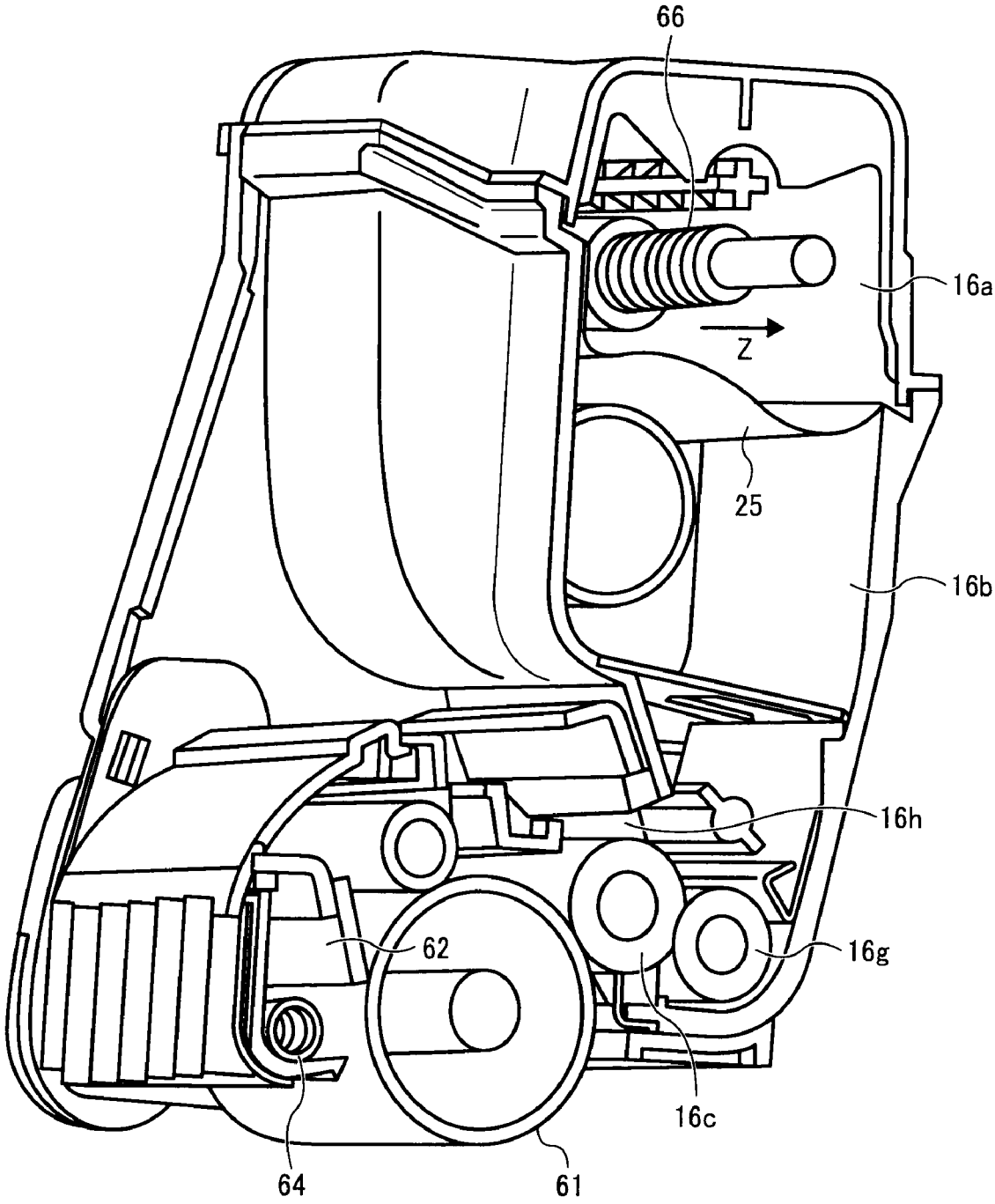
FIG. 6 is an exploded view of a toner cartridge in the process cartridge.
Figure 7:
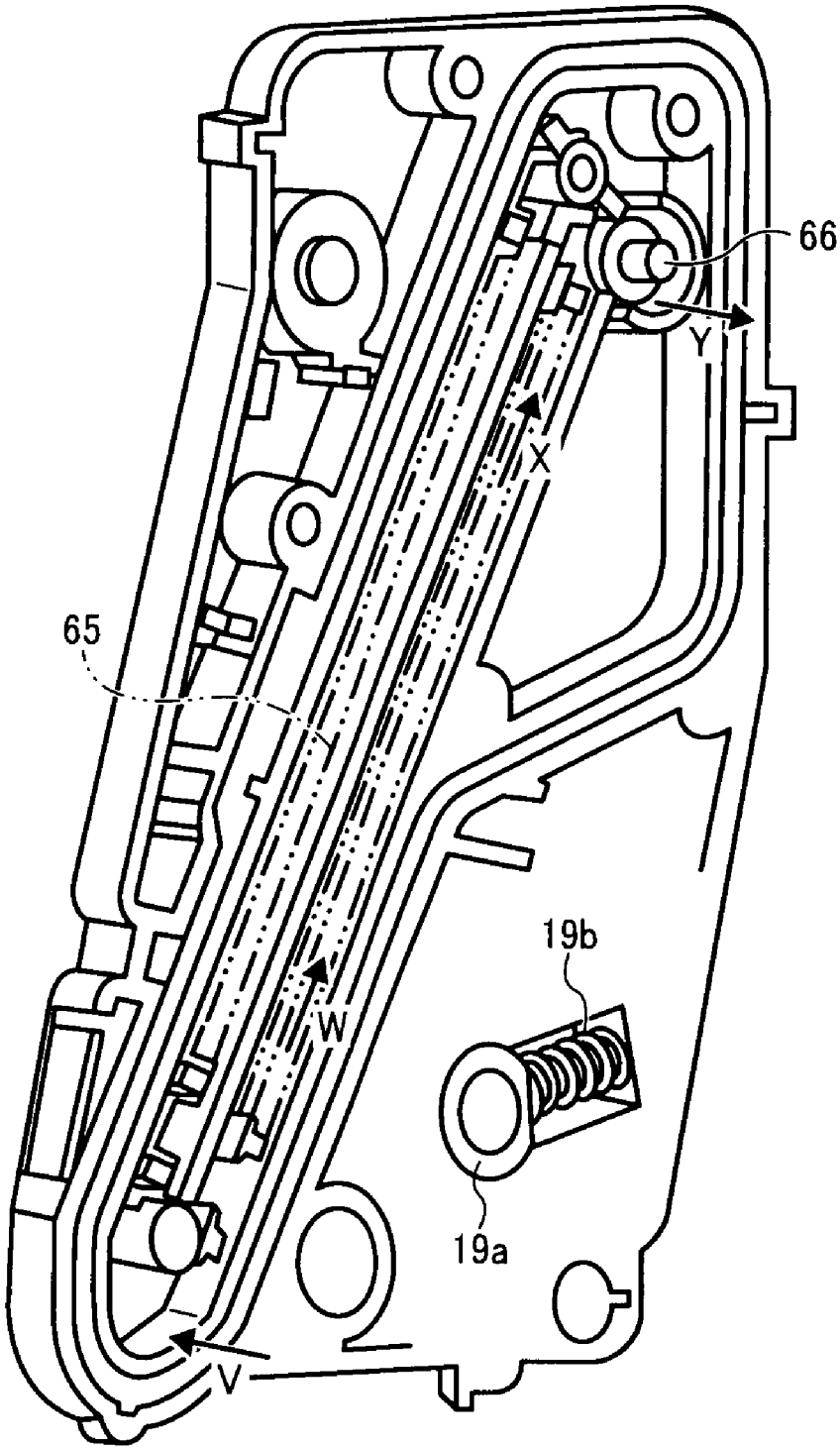
FIG. 7 is an exploded view of a residual toner carrying chamber in the toner cartridge.

Given below is the description of residual toner conveyance in the process cartridge shown in FIG. 3. As described above, when a toner image is primary-transferred from the photosensitive drum 61 on the intermediate transfer belt 3, the cleaning blade 62 removes the residual toner from the surface of the photosensitive drum 61. Subsequently, the toner conveying coil 64 horizontally conveys the residual toner to the toner conveying belt 65 in the direction indicated by an arrow V in FIG. 7. The toner conveying belt 65 then pumps up the residual toner in the direction indicated by arrows W and X in FIG. 7. Subsequently, a residual toner conveying screw 66 horizontally conveys the residual toner in the direction indicated by an arrow Z in FIG. 6 or an arrow Y in FIG. 7 such that the residual toner is uniformly collected in the residual toner collection chamber 16*a*. Moreover, by setting the direction V from a driving side toward a driven side, it becomes possible to arrange the residual toner conveying components in a space where no driving component is arranged thereby simplifying the layout of the process cartridge.

As shown in FIG. 4, a fresh toner filling opening 27 is created in the right lateral side of the toner cartridge housing 26*a* below the partitioning member 25. The fresh toner filling opening 27 is closed by a cap 29 to prevent the fresh toner from leaking out of the fresh toner storing chamber 16*b*. The residual toner conveying opening 22 is created in the right lateral side of the toner cartridge housing 26*a* above the partitioning member 25. The residual toner is conveyed in the residual toner collection chamber 16*a* through the residual toner conveying opening 22. Because the fresh toner filling opening 27 and the residual toner conveying opening 22 are created in the right lateral side of the toner cartridge housing 26*a* across the partitioning member 25, it is possible to prevent the residual toner from leaking out of the residual toner collection chamber 16*a* while the fresh toner is refilled through the fresh toner filling opening 27. Moreover, because the residual toner conveying unit 19 covers the right lateral side of the toner cartridge housing 26*a* from outside, a user is not able to remove the cap 29 while attaching the process cartridge to the main body of the image forming apparatus 1. Thus, the fresh toner is prevented from leaking out.

The residual toner discharging opening 23 is created in the right lateral side of the toner cartridge housing 26*a* above the partitioning member 25, while a residual toner discharging opening 24 is created in the left lateral side of the toner cartridge housing 26*a* above the partitioning member 25. The residual toner discharging openings 23 and 24 have an identical shape. When the process cartridge fits in the main body of the image forming apparatus, a sealing member 30 (e.g., a sponge or a polyethylene terephthalate (PET) sheet with a double-faced adhesive tape on one side, or a resin cap) seals each of the residual toner discharging openings 23 and 24. Thus, the residual toner is prevented from leaking out of the residual toner collection chamber 16*a*. Because the residual toner discharging openings 23 and 24 have an identical shape, identical sealing members 30 can be used for sealing. Moreover, the sealing members 30 easily stick to the residual toner discharging openings 23 and 24 because of the double-faced adhesive tape. Each sealing member 30 has a protrusion that fits into the residual toner discharging openings 23 and 24. As a result, the sealing members 30 are maintained in a correct position. Meanwhile, instead of separately creating the residual toner discharging opening 23, the residual toner conveying opening 22, through which the toner conveying belt 65 conveys the residual toner to the residual toner conveying screw 66, can be used as a residual toner discharging opening. When the process cartridge fits in the main body of the image forming apparatus 1 (see FIG. 1), the residual toner discharging openings 23 and 24 lie above the residual toner conveying screw 66 and the residual toner conveying opening 22. As a result, the residual toner conveyed in the residual toner collection chamber 16*a* accumulates below the residual toner discharging openings 23 and 24. Thus, sealing the residual toner discharging openings 23 and 24 by the sealing members 30 is sufficient to prevent the residual toner from leaking out.

As shown in FIG. 4, a rib 28 is arranged between the fresh toner filling opening 27 and the residual toner discharging opening 23. The rib 28 prevents the fresh toner from mixing with the residual toner. That is, while filling the fresh toner into the fresh toner storing chamber 16*b*, the rib 28 prevents the fresh toner from entering into the residual toner collection chamber 16*a* through the residual toner discharging opening 23. Moreover, while suctioning the residual toner from the residual toner collection chamber 16*a*, the rib 28 prevents the residual toner from entering into the fresh toner storing chamber 16*b* through the fresh toner filling opening 27.

Before refilling the fresh toner into the fresh toner storing chamber 16*b*, it is necessary to clean the toner cartridge 26. That is, the residual toner is discharged from the residual toner collection chamber 16*a*, while any remaining unused toner is discharged from the fresh toner storing chamber 16*b*. The residual toner can be discharged from the residual toner collection chamber 16*a* by using a suction apparatus (not shown). For that, first, the sealing members 30 are removed from the residual toner discharging openings 23 and 24. Then, the residual toner is suctioned through either one of the residual toner discharging openings 23 and 24. If the residual toner is to be suctioned through the residual toner discharging opening 23, then the toner cartridge 26 is rotated such that the residual toner discharging opening 23 faces downward. In such a case, air flows into the residual toner collection chamber 16*a* through the residual toner conveying opening 22 or the residual toner discharging opening 24. Because of the flow of air, it becomes possible to efficiently suction the residual toner. Meanwhile, before removing the sealing members 30 from the residual toner discharging openings 23 and 24, the residual toner conveying opening 22 can be closed by a cleaning cap (not shown). In that case, because the residual toner discharging openings 23 and 24 are placed opposite to each other, air convection does not occur inside the residual toner collection chamber 16*a* thereby enabling efficient suction of the residual toner. The process of suctioning the residual toner from the residual toner collection chamber 16*a* can be performed intermittently.

Figure 8:
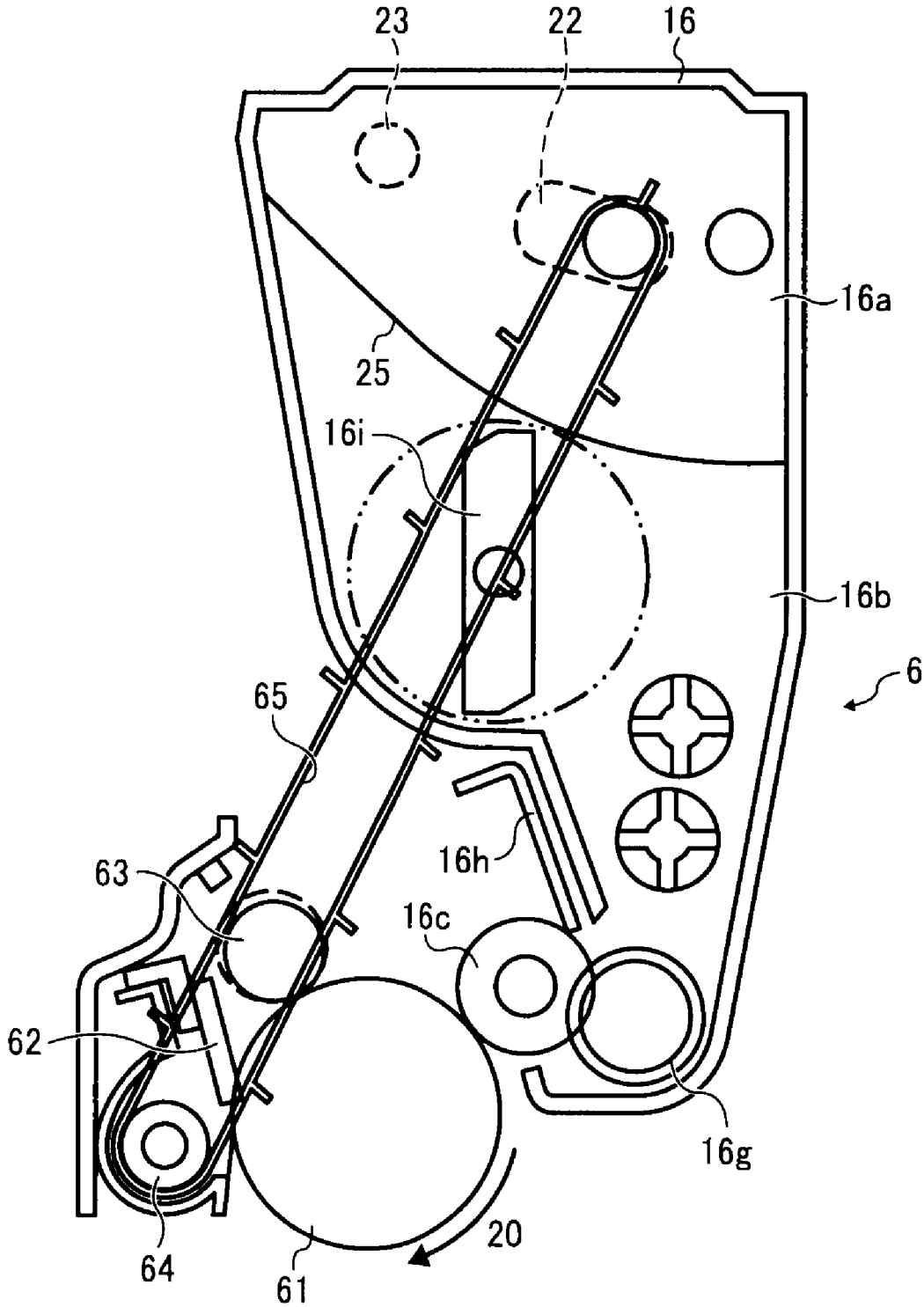
FIG. 8 is a schematic diagram of the process cartridge in which a partitioning member is bent in an opposite direction than in FIG. 2.

Instead of suctioning the residual toner, it is also possible to blow away the residual toner by blowing air through either one of the residual toner discharging openings 23 and 24 an air blower (not shown). If air is blown through the residual toner discharging opening 23, then the residual toner is blown away through the residual toner discharging opening 24. In that case, the toner cartridge 26 is rotated such that the residual toner discharging opening 24 faces downward. Meanwhile, it is necessary to close in advance the residual toner conveying opening 22 by a cleaning cap (not shown). When air is blown into the residual toner collection chamber 16*a*, the partitioning member 25 bends toward the fresh toner storing chamber 16*b* as shown in FIG. 8. When the air blower is stopped, the partitioning member 25 returns to the normal position as shown in FIG. 2. Because of the up-and-down movement of the partitioning member 25, the residual toner attached thereto is easily blown away. Moreover, by making the residual toner discharging opening 24 to face downward, it becomes easy to blow away the residual toner accumulated in the bottom part due to gravity.

Given below is the description of cleaning the fresh toner storing chamber 16*b*. As described above, the fresh toner storing chamber 16*b* is maintained in a sealed state by putting the cap 29 onto the fresh toner filling opening 27. Thus, by removing the cap 29, the fresh toner filling opening 27 can be used to discharge the remaining unused toner from the fresh toner storing chamber 16*b*. However, in that case, it is necessary to make sure that a toner filling nozzle does not make contact with the partitioning member 25. Moreover, it is necessary to fix the partitioning member 25 at such a position that the toner filling nozzle and the partitioning member 25 do not come in contact even when the partitioning member 25 bends toward the fresh toner storing chamber 16*b* when air is blown into the residual toner collection chamber 16*a* (see FIG. 8).

Figure 9:
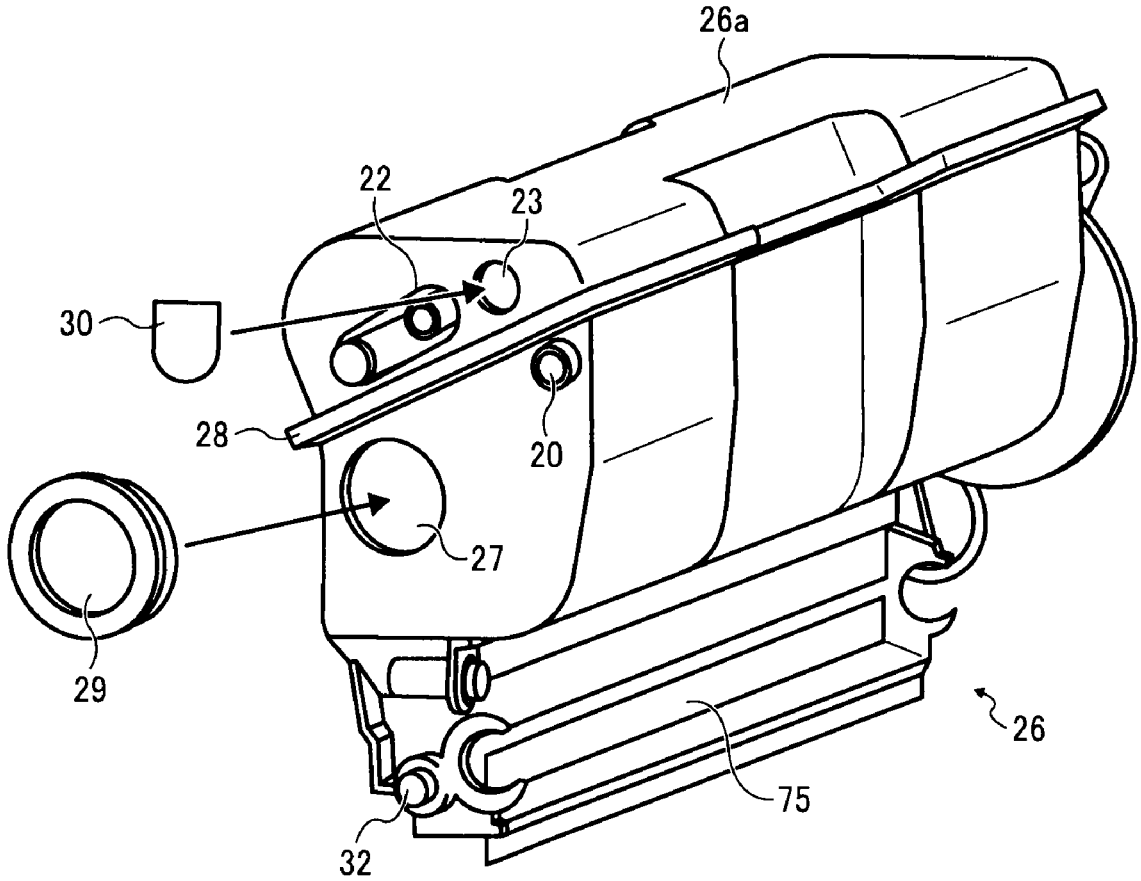
FIG. 9 is a perspective view of the process cartridge for explaining about an unused toner discharging opening.
Figure 10:
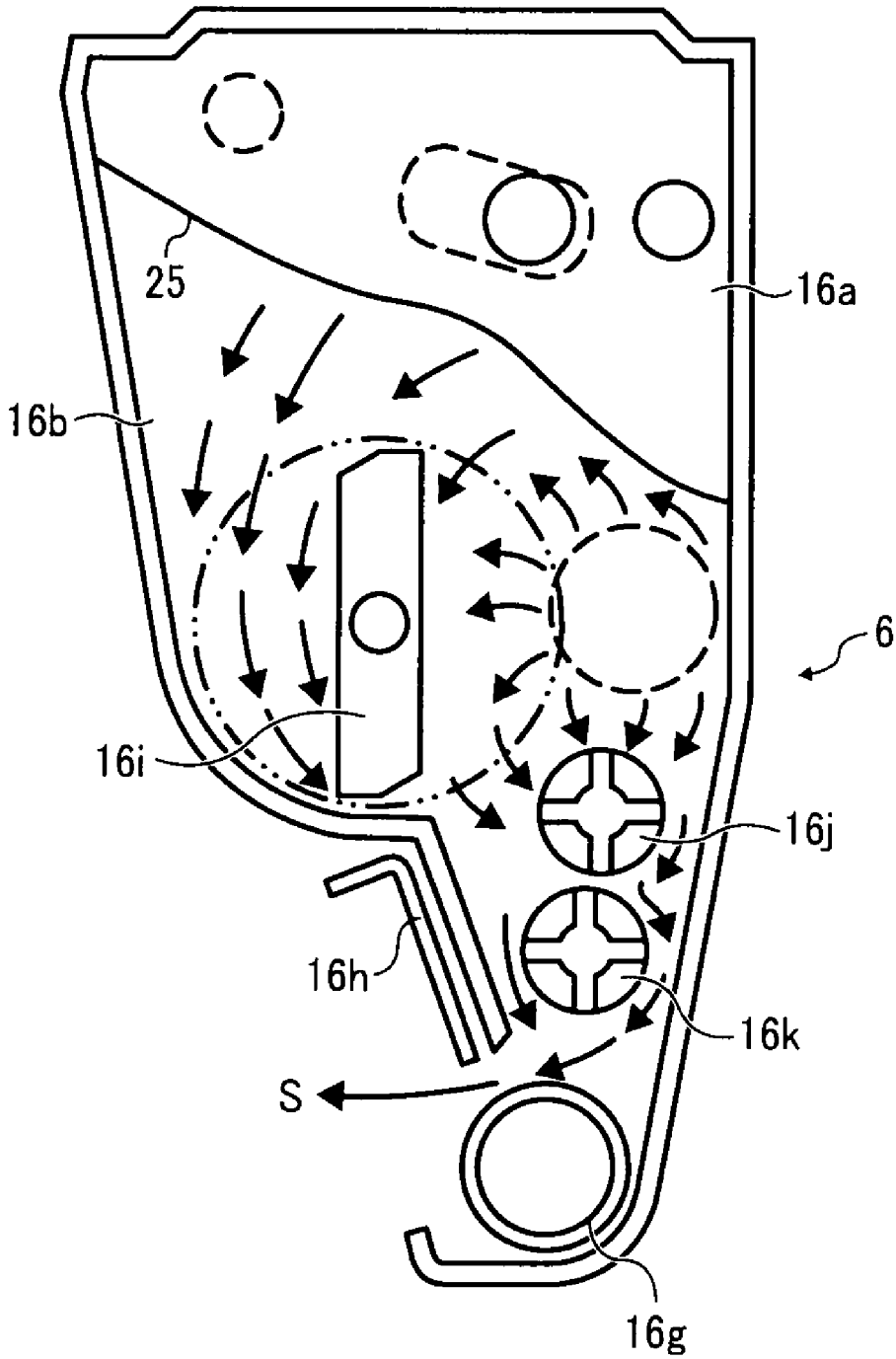
FIG. 10 is a schematic diagram of the process cartridge for explaining a flow of air inside the fresh toner storing chamber.

The remaining unused toner in the fresh toner storing chamber 16*b* can be discharged by dismounting the developing roller 16*c*. When the developing roller 16*c* is dismounted, an unused toner discharging opening is formed in the fresh toner storing chamber 16*b*. As shown in FIG. 5, the developing roller 16*c* is supported by a driving-side support bearing 76 and a driven-side support bearing 77. The driving-side support bearing 76 and the driven-side support bearing 77 are supported by the toner cartridge housing 26*a*. Thus, by removing the driving-side support bearing 76 and the driven-side support bearing 77 from the toner cartridge housing 26*a*, an unused toner discharging opening 75 is formed as shown in FIG. 9. When air is blown through the fresh toner filling opening 27, the remaining unused toner in the fresh toner storing chamber 16*b* comes out of the unused toner discharging opening 75. That is, as shown in FIG. 10, when air is blown through the fresh toner filling opening 27, the partitioning member 25 bends toward the residual toner collection chamber 16*a*. The air then circulates around the agitating gear 16*i*, the toner-circulating upper agitating screw 16*j*, the toner-circulating lower agitating screw 16*k*, and the toner supplying roller 16*g*, and comes out in the direction indicated by an arrow S along with the remaining unused toner. Because the developing roller 16*c* is often dismounted for cleaning or replacement, that opportunity can be used to clean the fresh toner storing chamber 16*b* thereby enhancing the work efficiency.

Figure 11:
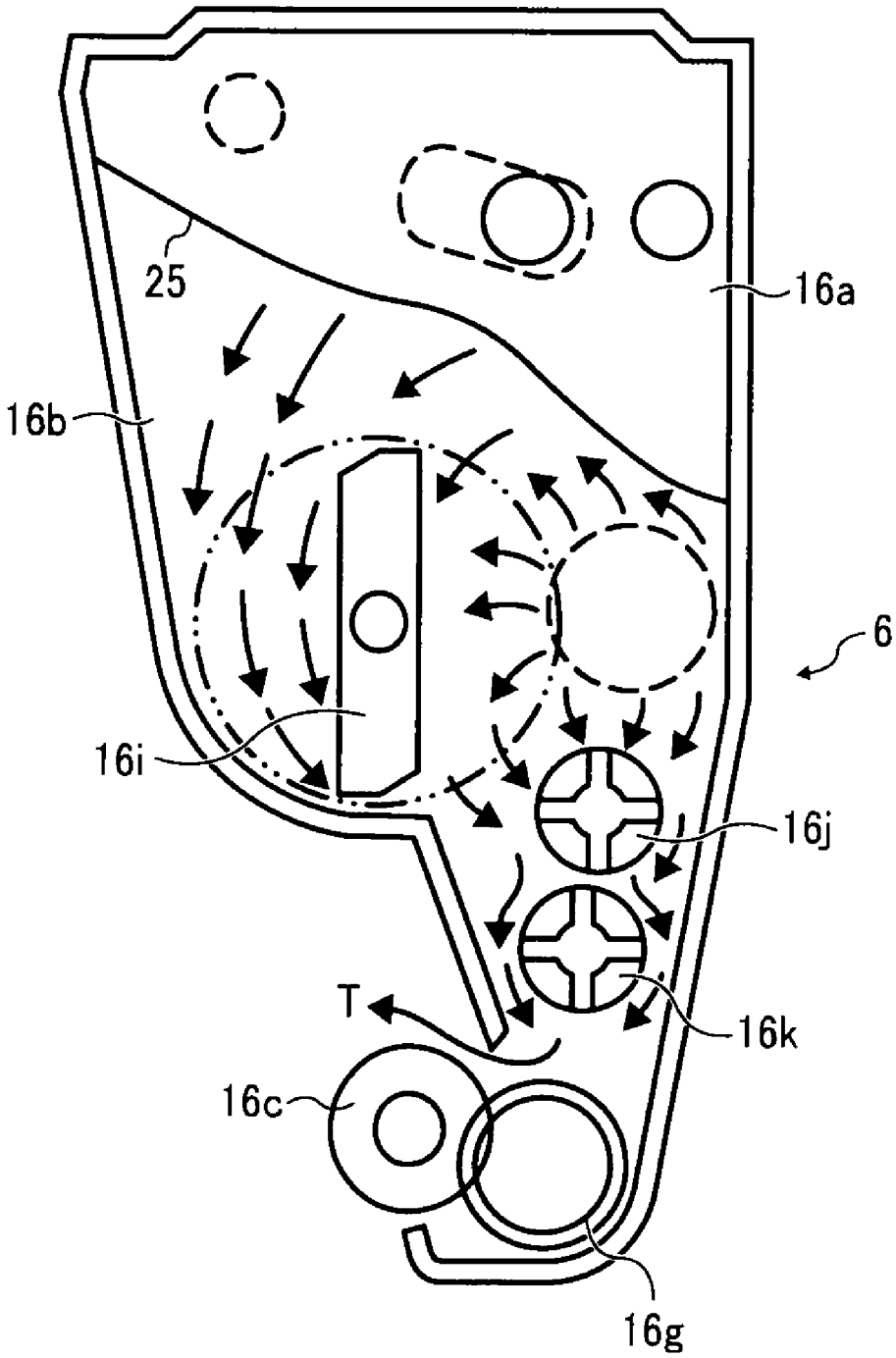
FIG. 11 is a schematic diagram of the process cartridge for explaining a flow of air inside the fresh toner storing chamber.

Meanwhile, instead of dismounting the developing roller 16*c*, it is possible to dismount the toner supply regulating blade 16*h*. In that case also, an unused toner discharging opening is formed. When air is blown through the fresh toner filling opening 27, the remaining unused toner in the fresh toner storing chamber 16*b* comes out of the unused toner discharging opening. As shown in FIG. 11, when air is blown through the fresh toner filling opening 27, the partitioning member 25 bends toward the residual toner collection chamber 16*a*. The air then circulates around the agitating gear 16*i*, the toner-circulating upper agitating screw 16*j*, and the toner-circulating lower agitating screw 16*k*, and comes out in the direction indicated by an arrow T along with the remaining unused toner. In this way, by dismounting the developing roller 16*c* or the toner supply regulating blade 16*h*, it is possible to efficiently clean the fresh toner storing chamber 16*b*. The developing roller 16*c* and the toner supply regulating blade 16*h* can also be dismounted at the same time.

Figure 12:
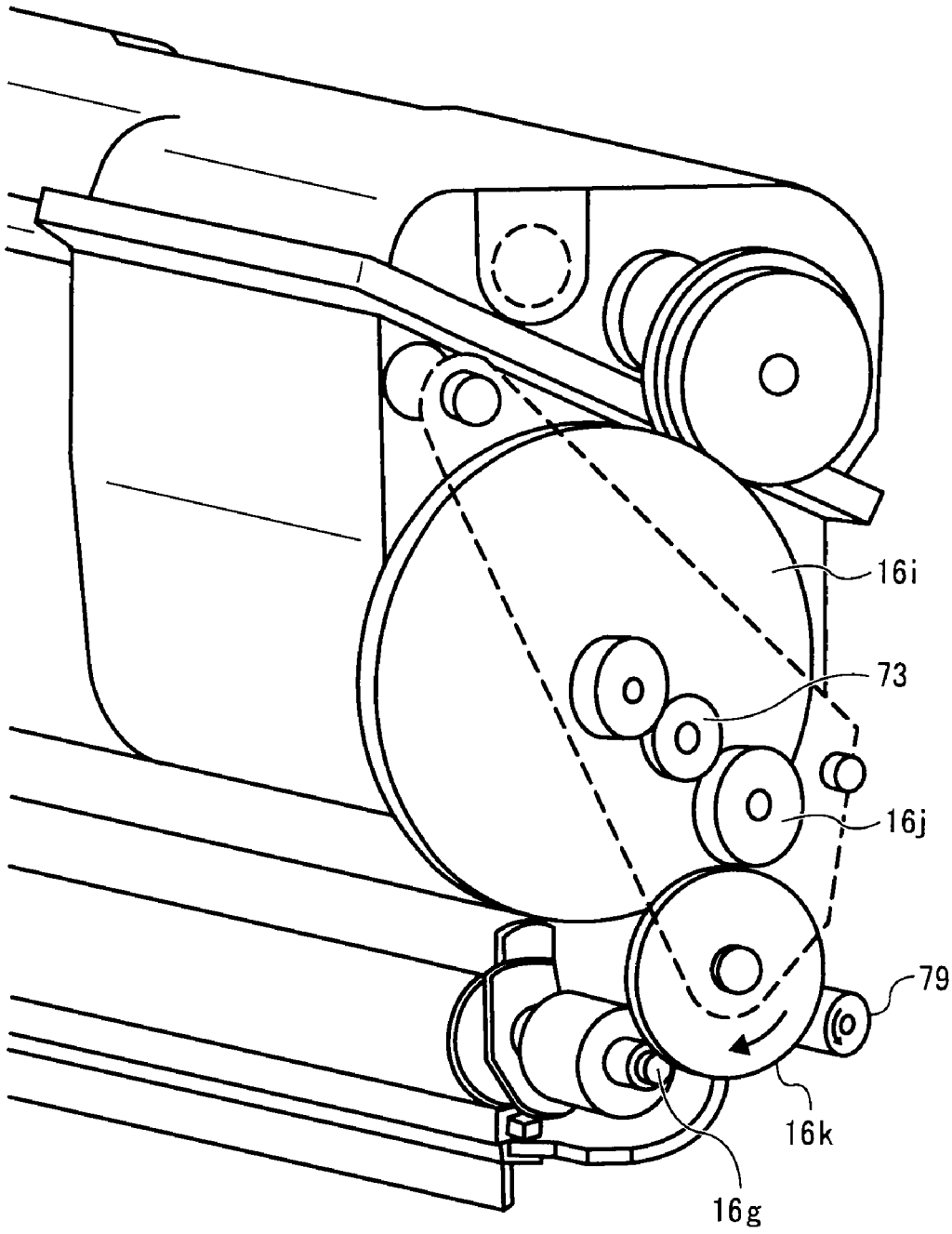
FIG. 12 is a schematic diagram of an exemplary rotatable gear train in the process cartridge.

Meanwhile, the fresh toner storing chamber 16*b* can also be cleaned by making use of a rotatable gear train arranged in the toner cartridge 26. FIG. 12 is a schematic diagram of the rotatable gear train. When a driving gear 79 is rotated in the anticlockwise direction by an external driving device (not shown), then the toner-circulating lower agitating screw 16*k* rotates in the clockwise direction such that the driving force is transmitted to the toner supplying roller 16*g* as well as to the agitating gear 16*i*, an idler gear 73, and the toner-circulating upper agitating screw 16*j*. While the driving force is being transmitted, air is blown through the fresh toner filling opening 27 (see FIGS. 10 and 11) such that the remaining unused toner attached to the gear train or the inner side of the toner cartridge housing 26*a* is easily blown away. Thus, to sum up, it is possible to efficiently clean the residual toner collection chamber 16*a* and the fresh toner storing chamber 16*b* by using a plurality of methods. In this way, the process cartridge can be made reusable thereby saving resources. Moreover, because the fresh toner is refilled in the fresh toner storing chamber 16*b* after removing the remaining unused toner, the quality of images formed subsequently can be maintained.

Meanwhile, to reduce the cleaning time, the residual toner collection chamber 16*a* and the fresh toner storing chamber 16*b* can be cleaned simultaneously. For that, first, the developing roller 16*c* or the toner supply regulating blade 16*h* is dismounted to create an unused toner discharging opening in the fresh toner storing chamber 16*b*. Then, air is simultaneously blown into the residual toner collection chamber 16*a* and the fresh toner storing chamber 16*b* through the residual toner discharging opening 23 and the fresh toner filling opening 27, respectively. As a result, the residual toner in the residual toner collection chamber 16*a* is blown away through the residual toner discharging opening 24, while the remaining unused toner in the fresh toner storing chamber 16*b* is blown away through the toner discharging opening. Instead of blowing air simultaneously, it is also possible to blow air alternately into the residual toner collection chamber 16*a* and the fresh toner storing chamber 16*b*. When air is blown into the residual toner collection chamber 16*a*, the air pressure therein increases and the partitioning member 25 bends toward the fresh toner storing chamber 16*b* (see FIG. 8). Subsequently, when air is blown into the fresh toner storing chamber 16*b*, the air pressure therein increases and the partitioning member 25 bends toward the residual toner collection chamber 16*a* (see FIG. 2). Thus, by forcing the partitioning member 25 to bend up and down, the toner attached on the surface of the partitioning member 25 or the inner side of the toner cartridge housing 26*a* can be blown away. In this way, it is possible to speedily and efficiently clean the developing unit 16 such that the process cartridge can be reused.

Thus, according to an aspect of the present invention, because two residual toner discharging openings are created in a residual toner collection chamber, negative air pressure is not generated inside a toner cartridge thereby enabling efficient suction of the residual toner.

Moreover, because the two residual toner discharging openings are placed opposite each other along a longitudinal direction of the residual toner collection chamber, air convection does not occur inside the residual toner collection chamber thereby enabling efficient suction of the residual toner. Furthermore, because the two residual toner discharging openings have an identical shape, an identical sealing member can be used for sealing them thereby reducing the number of components. Moreover, because the two residual toner discharging openings are covered by the sealing member when the toner cartridge fits in an image forming apparatus, the residual toner can be prevented from leaking out of the residual toner collection chamber. Furthermore, because the two residual toner discharging openings lie above a residual toner conveying opening when the toner cartridge fits in an image forming apparatus, the residual toner collected in the residual toner collection chamber accumulates below the residual toner discharging openings. Thus, sealing the residual toner discharging openings by the sealing member is sufficient to prevent the toner from leaking out. Moreover, because the two residual toner discharging openings lie above a rotatable agitating member when the toner cartridge fits in an image forming apparatus, the residual toner collected in the residual toner collection chamber accumulates below the residual toner discharging openings. Thus, sealing the residual toner discharging openings by the sealing member is sufficient to prevent the toner from leaking out.

Furthermore, because a fresh toner storing chamber and the residual toner collection chamber are partitioned by a slanting partitioning member, the residual toner in the residual toner collection chamber can be efficiently suctioned. Moreover, because a rib is arranged between a fresh toner filling opening and the residual toner conveying opening in a protruding manner with respect to the toner cartridge, the fresh toner and the residual toner can be prevented from getting mixed with each other. Furthermore, because the partitioning member is flexible in nature, the remaining unused toner or the residual toner attached to the partitioning member can be efficiently discharged.

Moreover, when the residual toner in the residual toner collection chamber is suctioned through either one of the two residual toner discharging openings after removing the sealing member, air flows into the residual toner collection chamber through the residual toner discharging opening not used for suctioning. Thus, negative air pressure is not generated inside the toner cartridge thereby enabling efficient suction of the residual toner. Furthermore, when air is blown intermittently through either one of the two residual toner discharging openings after removing the sealing member, the residual toner can be discharged from the residual toner collection chamber through the residual toner discharging opening not used for blowing air. In that case, because air convection does not occur inside the residual toner collection chamber, it is possible to efficiently suction the residual toner attached to the inner side of a toner cartridge housing. Moreover, because the toner cartridge is arranged such that one of the two residual toner discharging openings to be used for suctioning or blowing air faces downward, the residual toner or the remaining unused toner can be efficiently discharged.

Furthermore, when a developer conveying member arranged opposite to the fresh toner storing chamber is dismounted such that an unused toner discharging opening is formed, then the remaining unused toner in the fresh toner storing chamber can be discharged through the unused toner discharging opening. Thus, there is no need to create a separate toner discharging opening. Moreover, during that process, because the toner cartridge is arranged such that one of the two residual toner discharging openings to be used for discharging faces downward, the residual toner can be efficiently discharged. Furthermore, when air is blown through the fresh toner filling opening while rotating a rotatable agitating member, the remaining unused toner can be efficiently discharged.

Moreover, when air is blown simultaneously or alternately through the fresh toner filling opening and through either one of the two residual toner discharging openings, then the remaining unused toner and the residual toner is blown away simultaneously or alternately through the toner discharging opening and through one of the two residual toner discharging openings not used for blowing air, respectively. As a result, the cleaning time can be reduced. Particularly, when a flexible partitioning member is used, air can be blown alternately through the fresh toner filling opening and either one of the two residual toner discharging openings such that air pressure in the fresh toner storing chamber and the residual toner collection chamber varies alternately. As a result, the remaining unused toner or the residual toner attached to the partitioning member can be efficiently blown away.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A toner cartridge comprising:

a fresh toner storing chamber in which fresh toner is stored and has a mounting part for mounting a developer conveying member on a front side of the fresh toner storing chamber, the fresh toner being used for developing an image, and the fresh toner storing chamber having a fresh toner filling opening through which the fresh toner is filled therein; and a residual toner collection chamber in which residual toner is collected, the residual toner being a toner removed after an image is developed by using the fresh toner, the residual toner collection chamber having a residual toner conveying opening and a pair of residual toner discharging openings through which the residual toner can be discharged therefrom, the fresh toner storing chamber and the residual toner collection chamber being arranged integrally, wherein a longitudinal direction of the fresh toner storing chamber and a longitudinal direction of the residual toner collection chamber are in parallel, and wherein the residual toner collection chamber is positioned at a back side of the fresh toner storing chamber, the back side of the fresh toner storing chamber being opposite to the front side of the fresh toner storing chamber, wherein one of the residual toner discharging openings is formed on a first lateral side of the residual toner collection chamber and the other of the residual toner discharging openings is formed on a second lateral side of the residual toner collection chamber, the second lateral side being opposite to the first lateral side in the longitudinal direction of the residual toner collection chamber, wherein the fresh toner storing chamber and the residual toner collection chamber are partitioned by a slanting partitioning member such that the height of the front side of the residual toner collection chamber is smaller than the height of the back side of the residual toner collection chamber, whereby residual toner will tend to collect at the back side of the residual toner collection chamber, and wherein the pair of residual toner discharging openings are positioned on the lateral sides of the residual toner collection chamber at locations closer to the front side of the residual toner collection chamber than to the back side of the residual toner collection chamber.

2. The toner cartridge according claim 1, wherein the residual toner discharging openings have an identical shape.

3. The toner cartridge according to claim 1, wherein, when the toner cartridge is fit in an image forming apparatus, the residual toner discharging openings are sealed by a sealing member.

4. The toner cartridge according to claim 3, wherein, when the toner cartridge is fit in the image forming apparatus, the residual toner discharging openings are located above the residual toner conveying opening.

5. The toner cartridge according to claim 3, wherein the residual toner collection chamber includes a rotatable agitating member that conveys and agitates the residual toner, and when the toner cartridge is fit in the image forming apparatus, the residual toner discharging openings are located above the agitating member.

6. The toner cartridge according to claim 1, wherein a rib is arranged between the fresh toner filling opening and the residual toner conveying opening in a protruding manner with respect to the toner cartridge.

7. The toner cartridge according to claim 1, wherein the fresh toner storing chamber and the residual toner collection chamber are partitioned by a flexible partitioning member.

8. A process cartridge that is configured by integrally arranging a photosensitive drum, a developing unit, and the toner cartridge according to claim 1.

* * * * *